United States Patent [19]

Perkins et al.

[11] 4,145,165

[45] Mar. 20, 1979

[54] LONG STROKE PUMP

[75] Inventors: Gerald S. Perkins; Nicholas R. Moore, both of Altadena, Calif.

[73] Assignee: California Institute of Technology, Pasadena, Calif.

[21] Appl. No.: 774,229

[22] Filed: Mar. 4, 1977

[51] Int. Cl.[2] ..... F04B 17/04

[52] U.S. Cl. ..... 417/418; 92/60.5; 310/80

[58] Field of Search ..... 417/410, 415–418, 417/274, 355, 356, 568; 92/60.5; 74/25, 89.15; 310/80, 83

[56] References Cited

U.S. PATENT DOCUMENTS

| | | | |
|---|---|---|---|
| 996,128 | 6/1911 | Payne et al. | 128/218 A |
| 2,067,819 | 1/1937 | Bell | 417/418 |
| 2,446,393 | 8/1948 | Russell | 310/83 |
| 2,508,253 | 5/1950 | Haggardt | 417/356 |
| 2,647,683 | 8/1953 | Schweller | 92/60.5 |
| 2,820,415 | 1/1958 | Born | 417/437 |
| 2,841,092 | 7/1958 | Whiteman et al. | 417/568 |
| 3,070,023 | 12/1962 | Glasgow | 417/568 |
| 3,179,057 | 4/1965 | Cosner | 417/437 |
| 3,278,774 | 10/1966 | Roller et al. | 310/80 |
| 3,330,217 | 7/1967 | Baur et al. | 417/454 |
| 3,446,118 | 5/1969 | Kuhara | 417/274 |
| 3,461,805 | 8/1969 | Karkow | 417/568 |
| 3,556,679 | 1/1971 | Middlebusher et al. | 417/317 |
| 3,979,999 | 9/1976 | Emenaker | 92/33 |

FOREIGN PATENT DOCUMENTS

| | | | |
|---|---|---|---|
| 164276 | 11/1953 | Australia | 92/60.5 |

*Primary Examiner*—C. J. Husar

*Attorney, Agent, or Firm*—Freilich, Hornbaker, Wasserman, Rosen & Fernandez

[57] ABSTRACT

A very high pressure pump apparatus which minimizes wear on the seals thereof and on valves connected thereto, by utilizing a very long stroke piston rod whose opposite ends are received in long cylinders. An electric motor which drives the rod, includes a rotor with a threaded aperture that receives a long threaded middle portion of the rod, so that as the rotor turns it advances the rod.

8 Claims, 2 Drawing Figures

LONG STROKE PUMP

ORIGIN OF INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

Hydrocarbon wells are normally drilled by utilizing a mud-water mixture which is pumped down through the drill pipe to exit through orifices in the drill bit. The mud loosens chips, cleans the drill cone teeth, and hydraulically floods out the debris. Such mud is typically pumped at the rate of 200 to 300 gallons per minute at pressures between 2,000 and 3,000 psi. The speed at which holes can be drilled, and the life of the drill bit, are limited by the capability of the bearings in the bit mechanism, and significant further improvements in the bearing lifetimes do not appear likely.

An increase in the life of a drill bit is of great importance, especially for deep hole drilling. A rule of thumb is that one hour is required to pull one thousand feet of drill string, and since some strings are 15,000 feet or more in length, it can be seen that minimizing the frequency of pulling the drill string to replace the drill bit, is of considerable economic importance.

It has been realized for some time that increasing the drilling fluid pressure holds promise of significantly lengthening the cutting life of the drill bit. Higher pressure mud emerging through the nozzles at the hole bottom, is alone capable of exerting sufficient force to fracture the formation being drilled. Full-scale testing in the field, using high pressure drilling equipment, has confirmed that in general, pressures in excess of the minimum pressure required to break a given rock formation would increase the drilling speed significantly. High pressure drilling rates were indicated to be as much as three times the rates of conventional rotary drilling, with the bit life proportionately longer. It also may be noted that the inclusion of shot in the mud has been known to increase drilling rates significantly but only at high pressures that have not been economically available. Thus, the availability of high mud pressures would not only increase drilling speed during actual drilling, but would reduce the number of times that the drill string had to be pulled for replacement of a bit.

Although the use of very high pressure mud could provide great advantages, it has the significant disadvantage of causing greatly increased equipment breakdowns, particularly for the pump and its valves. For example, conventional triplex pumps which are ordinarily used for hole drilling, were utilized to achieve high pressures by overdriving them. However, failure of such pumps occurred with a few hours of operation. Failure occurs primarily at the valve seats which can be rapidly worn when particles are pressed against them with great force every time the valve is closed, which occurs in every cycle of a reciprocating pump. High pressure mud pumping apparatus which had a longer life, would enable the economic utilization of very high drill fluid pressures, to thereby enable the more economic drilling of holes.

SUMMARY OF THE INVENTION

In accordance with one embodiment of the present invention, a very high pressure pump is provided which can be economically constructed and which enables the fluid-control vales operating therewith to operate with a long lifetime. The pump includes a long rod with a threaded middle portion, and with opposite ends received in a pair of pump cylinders. A motor located at the middle portion of the rod, includes a rotor with a threaded aperture which threadably receives the middle portion of the rod. The rod is restrained from rotation, so that as the rotor rotates, the rod is driven in one direction to move further into one cylinder and pump out any fluid therein, the rotor then being reversed to move the rod in the opposite direction. Valves connected to each of the cylinders control the inflow and outflow of fluid therefrom. Each of the rods have a stroke length, much longer than the diameter of the rod, such as more than five times as great, so that a large amount of fluid is pumped at every stroke of the rod, in spite of the use of a rod of only moderate diameter. Since each valve opens and closes only once during each reciprocation of the rod, there are a fewer number of valve openings and closings for a given amount of fluid pumped, to thereby increase the lifetime of the valve.

The novel features that are considered characteristic of this invention are set forth with particularity in the appended claims.

The invention will be best understood from the following description when read in connection with the accompanying drawings.

DESCRIPTION OF THE PREFERRED EMBODIMENT

Figure 1:
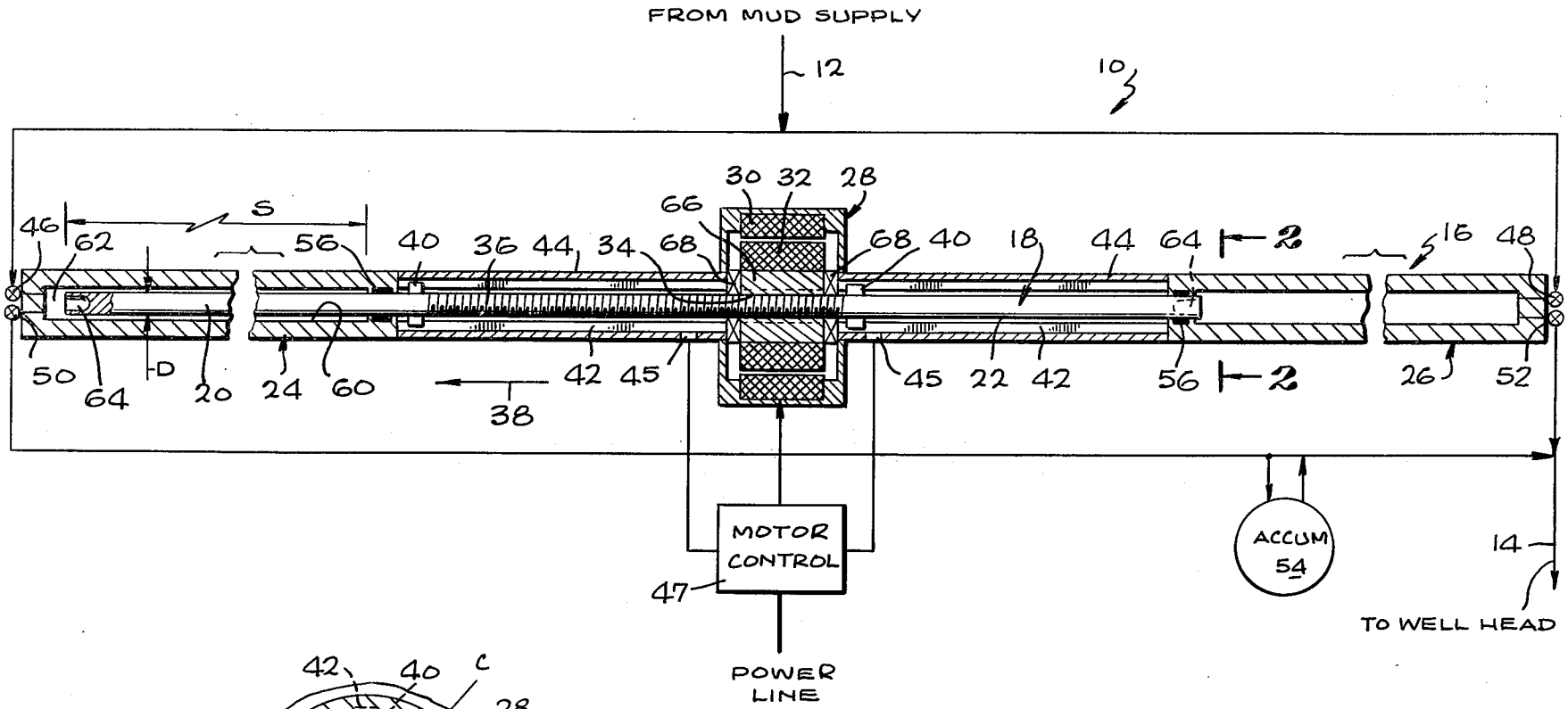
FIG. 1 is a sectional side view of a pump system constructed in accordance with one embodiment of the present invention.
Figure 2:
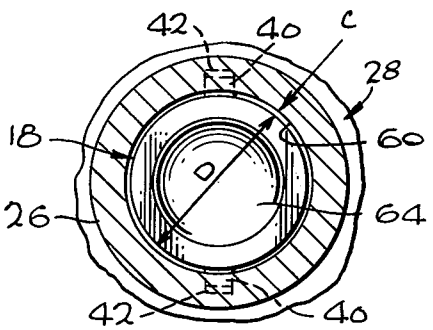
FIG. 2 is a view taken along line 2—2 of FIG. 1.

The figures illustrate a pumping system 10 which receives mud through an input line 12, and which delivers the mud through an output line 14 at very high pressure. Pumping is accomplished by a pump 16 which includes a long rod 18 whose end portions 20, 22 can be received in cylinders 24, 26. The rod is reciprocated by an electric motor 28 which includes a stator 30 and an armature or rotor 32. The armature has a threaded aperture 34 which engages a threaded middle portion 36 of the rod. Thus, when the rotor 32 turns in a first direction, it causes the rod to move axially in the direction of arrow 38 to force fluid out of the cylinder 24. When the rotor turns in a reverse direction, it causes the rod to move into the other cylinder 26. The rod is prevented from rotating by bosses 40 thereon which are received in slots 42 of a housing 44.

A pair of limit switches 45 in the path of the bosses 40, sense the approach of the rod to each of its extreme positions, to operate a motor control 47 that controls current flow from a power line to the motor, to reverse the motor.

The inflow of mud to the cylinders 24, 26 is controlled by check valves 46, 48 that permit fluid flow only into the cylinders. The outflow of mud from the cylinders is controlled by another set of check valves 50, 52. An accumulator 54 maintains pressure in the outlet line 14 in between strokes of the rod. Each of the check valves 46–52 is of the conventional type which includes a plunger biased against a valve seat. Where very high pressure such as 20,000 psi are utilized, wherein the valve plunger is pressed with great force against its valve seat, particles caught betwwen the plunger and valve seat can wear them. The lifetime of the valve is largely determined by the number of times the valve opens and closes. In a somewhat similar manner, seals 56 which seal against the rod 18, have a lifetime partially determined by the number of reciprocations of the rod against the seal.

In order to minimize wear on the check valves 46–52 and seals such as 56, the pump is constructed so that the distance of rod travel, or stroke, has a length S many times greater than the diameter D of the rod. For example, for a rod of diameter D of eight inches, a stroke S such as 100 inches is utilized. In commonly used pumps, a piston of a diameter on the order of 8 inches might be utilized, which would have a stroke of only about 8 to 12 inches and which would be rapidly reciprocated at a rate such as 100 per minute. The present apparatus can deliver the same volume by reciprocating it at a rate such as six per minute. Large horsepower, low speed, motors are readily available to enable the direct coupling of the motor rotor to the rod in the above-described manner.

The pump can be operated with the axis of the rod 18 substantially horizontal to facilitate support of the structure on the ground. The great length of the rod can result in appreciable bending. In order to minimize the degree of precision of the pump parts, the bore 60 of the cylinder is made considerably larger than the diameter D of the rod (which has no piston rings) to leave a considerable clearance space C between them. For example, with a rod of eight inches diameter, a clearance C of perhaps 1/16 inch can be utilized which avoids sealing contact of the rod with the cylinder. The long length of the rod stroke compared to its diameter, means that a large amount of fluid is pumped during each cylinder stroke regardless of such a clearance. The clearance space as well as an unpumped region 62 at the end of the cylinder 24, provides a quantity of fluid which serves as a spring which helps to reverse the movement of the rod 18 at the end of its stroke. This is helpful in reducing the maximum load on the motor 28, inasmuch as the maximum load occurs at the end of each stroke of the rod when the motor must reverse direction. At the high pressures such as 20,000 psi delivered by the pump, the mud in the cylinder, and particularly the water portion thereof, undergoes considerable elastic compression so that it acts as a spring that helps reverse the motion of the rod. The motor is deenergized before the rod reaches the end of its stroke, and the compressed fluid slows and then begins to reverse the rod to minimize the start-up load on the motor.

In order to lighten the rod ends, which are the most overhanging portions, a deep cavity 64 is formed in each end of the rod. The cavity also provides a region for holding some of the fluid which is to act as a spring to reverse the rod motion, so that the cylinder 24 can be made slightly smaller in length.

In order to threadably couple the rotor 32 of the motor to the threaded portion of the rod, a low friction bearing 66 is utilized, such as a recirculating ball type wherein the balls serve as threads. A pair of hydrostatic thrust bearings 68 are also provided at the opposite ends of the rotor to withstand the large thrust applied to them. The housing 44 which connects the motor to each cylinder, carries forces to hold the cylinders in place with respect to the motor.

Thus, the invention provides a high-pressure pump of economical design, and which produces minimum wear on its associated check valves and seals. This is accomplished by utilizing a long rod whose opposite ends are received in long cylinders and whose middle portion is threadably driven by the rotor of a reversable electric motor. The length of the rod stroke is at least five times, and preferably at least ten times, the diameter of the rod ends, to enable large volumes of fluid to be pumped with less frequent reversals of rod movement. This reduces breakdowns of the motor, valves, and seals, whose lifetimes are significantly if not primarily determined by the number of reciprocations of the rod. The long stroke also enables the entrapment of considerable fluid in the cylinders without greatly decreasing the volume of pumped fluid, so that sealing between the extreme end of the rod and cylinder bore does not have to occur. This reduces the cost of the pump and also aids in utilizing trapped fluid as a spring to help reverse the rod. This also enables cavities to be formed at the ends of the rods to lighten the overhanging rod portions.

Although particular embodiments of the invention have been described and illustrated herein, it is recognized that modifications and equivalents may readily occur to those skilled in the art and consequently it is intended that the claims be interpreted to cover such modifications and equivalents.

What is claimed is:

1. Apparatus for pumping large volumes of oil well drilling mud at very high pressure comprising:

a rod having a pair of ends and a middle portion;

a motor having a stator and a rotor, said middle portion of said rod threadably coupled to said rotor to move the rod axially as the rotor turns;

a pair of cylinders receiving the opposite ends of said rod;

means for energizing said motor to rotate said rotor in alternate directions, to reciprocate said rod over a predetermined stroke length; and a pair of outlet valves coupled to said cylinders to control the outflow of drilling mud therefrom;

said stroke length being more than five times the diameter of either end of said rod.

2. The apparatus described in claim 1 wherein:

said stroke length is at least ten times the diameter of either end of said rod.

3. A heavy duty, large volume, high pressure pump comprising:

a motor having a thread-engaging bearing;

a rod having a threaded middle portion threadably disposed in said bearing, said rod being restrained from rotation but being axially movable;

a pair of cylinders, each receiving a different end of said rod;

valve means connected to said cylinders, for allowing the inflow or outflow of fluid with respect to each cylinder as the rod moves in directions respectively out of or into the cylinder; and means responsive to the rod approaching each of two opposite predetermined positions, for effectively reversing said motor to rotate the bearing in an opposite direction;

the axial movement of said rod between said positions being at least five times the diameter of either end of the rod, whereby to minimize reversals of valve means operation for a given volumetric rate of pumping.

4. The pump described in claim 3 wherein:

said axial movement of said rod is at least ten times the diameter of either end of the rod.

5. A method for pumping large volumes of oil well drilling mud at very high pressures, comprising:

reciprocating a pump piston in a pump cylinder, so the piston alternately moves axially forward into the cylinder and axially rearwardly out of the cylinder;

keeping an inlet valve open during at least some of the rearward piston movement to let mud flow into the cylinder; and keeping an outlet valve open during at least some of the forward piston movement to permit the outflow of mud, including closing the outlet valve at about the time the piston stops moving forward to begin moving rearwardly;

said step of reciprocating including moving said piston an axial distance of more than five times the diameter of the piston end which lies in said cylinder during said forward movement and during said rearward movement, whereby to minimize wear on the outlet valve in a pump of moderate size.

6. The method described in claim 5 wherein:

said step of reciprocating includes moving said piston an axial distance of at least ten times the diameter of the piston end.

7. The method described in claim 5 wherein:

said step of reciprocating includes repeatedly reversing the current flow to an electric motor which has a rotor threadable coupled to said rod, maintaining a separate cylinder at each of the opposite ends of said piston, and pumping drilling mud which is significantly compressible at pressures on the order of 20,000 psi alternately out of each cylinder at a pressure on the order of 20,000 psi, whereby to utilize the resilience of compressed fluid to aid in reversing the piston to thereby minimize motor load.

8. A heavy duty, high volume, pump for pumping liquid at on the order of 20,000 psi, comprising:

an electric motor having a stator and a rotor, said rotor having a thread-engaging bearing;

a piston rod having a threaded middle portion threadably disposed in said bearing in a low friction threadable engagement with the bearing;

a pair of cylinders receiving different ends of said piston rod;

an inlet valve connected to each cylinder to permit the inflow of liquid therein;

an outlet valve connected to each cylinder to permit the outflow of liquid therefrom at a pressure on the order of 20,000 psi;

means for reversing the flow of current to said motor to reverse it after it moves said rod by a predetermined axial distance into one cylinder and out of the other;

said axial distance being at least ten times the diameter of either end of said rod, whereby to minimize valve wear, and whereby to allow liquid pressure to help reverse the piston rod to minimize motor start-up load.

* * * * *